US005118589A

United States Patent [19]

Aslam et al.

[11] Patent Number: 5,118,589

[45] Date of Patent: Jun. 2, 1992

[54] METHOD AND APPARATUS FOR TREATING TONER IMAGE BEARING RECEIVING SHEETS

[75] Inventors: Muhammad Aslam, Rochester; Thomas J. Farnand, Webster, both of N.Y.

[73] Assignee: Eastman Kodak Company, Rochester, N.Y.

[21] Appl. No.: 548,319

[22] Filed: Jul. 5, 1990

[51] Int. Cl.[5] ..... G03G 13/20; G03G 15/20

[52] U.S. Cl. ..... 430/124; 430/99; 355/284; 355/290

[58] Field of Search ..... 430/99, 124; 355/284, 355/290

[56] References Cited

U.S. PATENT DOCUMENTS

| | | | |
|---|---|---|---|
| 4,429,987 | 2/1984 | Chang et al. | 355/290 |
| 4,639,405 | 1/1987 | Franke | 430/124 |
| 4,780,742 | 10/1988 | Takahashi et al. | 430/124 X |
| 4,958,195 | 9/1990 | Firth et al. | 430/124 X |
| 5,017,970 | 5/1991 | Sakata | 355/290 |

FOREIGN PATENT DOCUMENTS

| | | |
|---|---|---|
| 0301585 | 2/1989 | European Pat. Off. . |
| 92965 | 4/1988 | Japan . |

*Primary Examiner*—Roland Martin
*Attorney, Agent, or Firm*—Leonard W. Treash, Jr.

[57] ABSTRACT

A toner image carried on a receiving sheet which receiving sheet includes a heat softenable outer layer is fixed or finished by being fed into a nip between a pair of pressure members. The pressure members either embed the toner in the layer or apply a gloss or texture to the heat softenable layer. To eliminate an image defect at the leading edge of the sheet, the pressure between the pressure members is applied by a means having two conditions, one in which said pressure is applied and a second in which it is relaxed. The sheet is sensed as it approaches the nip and the pressure applied just as or after the nip is reached by the leading edge of the sheet.

4 Claims, 4 Drawing Sheets

METHOD AND APPARATUS FOR TREATING TONER IMAGE BEARING RECEIVING SHEETS

TECHNICAL FIELD

This invention relates to finishing toner images and more particularly to method and apparatus of treating a receiving sheet having a heat-softenable layer carrying a toner image.

BACKGROUND ART

In electrophotography, multicolor images having resolution and other qualities comparable to those of silver halide photography have been produced in the laboratory. One reason such systems have not been commercially practical is they have generally required liquid developing for high quality. However, recent advances in fine particle dry toners have made low-grain, high-resolution images feasible with dry systems.

U.S. patent application Ser. No. 07/405,258, filed Sep. 11, 1989, entitled TONER FIXING METHOD AND APPARATUS AND IMAGE BEARING RECEIVING SHEET, to Rimai et al, discusses a problem with such high resolution dry images that when they are put through an ordinary roller fuser they both spread, losing resolution, and exhibit a substantial relief image according to the varying thickness of toner layers in the image. The Rimai et al application suggests using a hard ferrotyping belt to embed the toner in a heat softened thermoplastic layer. The combination of relatively high pressure and the heat softened thermoplastic layer both substantially embeds the toner in the layer substantially reducing the relief and also applies a gloss to the image that is highly desirable in such a print.

U.S. patent application Ser. No. 07/409,194, filed Sep. 19, 1989, entitled METHOD AND APPARATUS FOR TREATING TONER IMAGE BEARING RECEIVING SHEETS, Baxter et al, deals with texturizing or adding gloss to a toner image-bearing receiving sheet generally of the type described in the Rimai et al application, that is, having a toner image on a thermoplastic layer. In this application the toner image-bearing sheet is fed between a pair of pressure rollers, one of which may have a texturizing surface and one of which is heated to again soften the thermoplastic layer to help impart the proper gloss or texture to its surface. To prevent offset of the thermoplastic layer onto the pressure roller contacting it, the layer was heated primarily by the roller contacting the side of the receiving sheet opposite the heat softenable layer.

The processes in the above two applications are done without the use of fusing oils because fusing oils leave image defects that are unacceptable with extremely high quality prints.

Japanese Kokai 63-92965 (1988), laid-open Apr. 23, 1988, suggests a method of increasing the gloss of a toner image bearing thermoplastic coated receiving sheet in which the receiving sheet is fed between a pair of pressure rollers to both reduce relief and to add gloss.

European Patent Application 0301585 published Feb. 1, 1989 shows a glazing sheet used to increase the gloss of either a toner image on paper backing or a dye and developer in a thermoplastic coating.

U.S. Pat. No. 4,639,405 shows a post-treatment step to add gloss to a toner image carried on a paper after ordinary fusing. The fixed image bearing paper is dried and then pressed between a pair of heated rollers which increase the gloss of the image.

U.S. Pat. No. 4,780,742 shows a method of increasing the gloss of a fixed toner image by coating it with a thin sheet in the presence of heat and pressure.

STATEMENT OF THE INVENTION

In finishing receiving sheets using some of the methods described in the above documents, it is desirable to feed the receiving sheet into the nip of a pair of moving pressure members which are urged together by enough force to create substantial pressures on the receiving sheet in the nip, for example, pressures up to 100 pounds per square inch and higher. In order to get high pressure, the member is urged together by forces as large as 40 pounds per linear inch and the pressure members are commonly hard metallic rollers. As suggested in the Rimai application, one of the rollers may be covered by a ferrotyping belt of nickel, stainless steel, or the like.

In many instances, an image defect occurs in this process associated with the leading one-eighth of an inch or so of the image. The leading edge of the thermoplastic layer has a tendency to offset onto the hot pressure member contacting it, leaving a visible mark on the final print and requiring cleaning of the pressure member.

It is an object of this invention to provide apparatus and method of heat and pressure treating a toner image-bearing thermoplastic coated receiver sheet without exhibiting this image defect associated with the leading edge of the thermoplastic layer.

This and other objects are accomplished by a mechanism for urging the pressure members together with sufficient force to embed the toner image in the heat softenable layer or to apply a gloss or texturized finish to the layer. The urging means is adjustable between a first condition in which the force is applied and a second condition in which the force is relaxed. A sensing means senses a receiving sheet approaching the nip and adjusts the urging means from its second condition to its first condition as or just after the leading edge of the sheet reaches the nip.

With this approach, the full pressure of the pressure members is applied directly to the top of the heat softenable layer after it is into the nip. Any hesitation of the rollers is spread over the beginning portion of the layer which does not cause any particular portion of it to become overheated.

According to a preferred embodiment, a means for sensing the leading edge of the receiving sheet as it approaches the nip generates an electrical signal in response to such sensing. The electrical signal is delayed an amount of time allowing the leading edge to move from the position at which it is sensed to a position in the nip.

BRIEF DESCRIPTION OF THE DRAWINGS

In the detailed description of the preferred embodiment of the invention presented below, reference is made to the accompanying drawings, in which.

BEST MODE OF CARRYING OUT THE INVENTION

Figure 1:
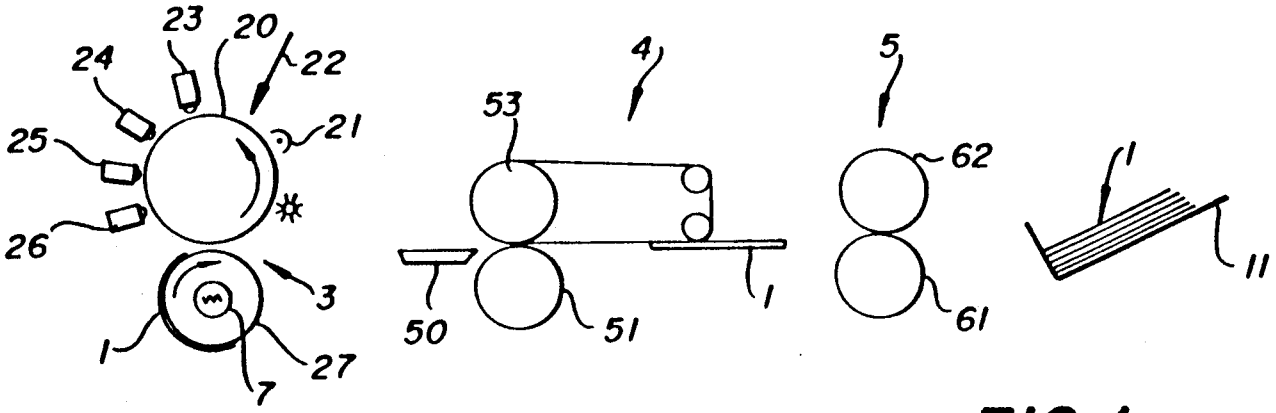
FIG. 1 is a side schematic view of an apparatus for carrying out a method of producing finished multicolor toner images.

According to FIG. 1 a receiving sheet 1 is fed along a path through a series of stations. The receiving sheet 1 is shown in section in FIG. 2 and has a paper support 10 with a readily softenable thermoplastic layer 9 coated on its top side. Preferably, the paper support 10 also has a curl preventing coating 8 on its bottom side. These materials will be explained in more detail below.

Receiving sheet 1 is fed through a path past an image transfer station 3, fixing station 4 and a texture or gloss applying station 5 and into a receiving hopper 11.

A multicolor toner image can be formed by a number of means on receiving sheet 1. For example, according to FIG. 1, a photoconductive drum 20 is uniformly charged at a charging station 21, exposed by a laser, an LED or an optical exposure device at exposure station 22 and toned by different color toning stations 23, 24, 25 and 26. Consistent with conventional color electrophotography, consecutive images are toned with different colors by toning stations 23–26. The consecutive images are then transferred in registry to the surface of receiving sheet 1 at transfer station 3 where sheet 1 is secured to transfer roller 27 and repetitively brought into transfer relation with the images to form a multicolor toner image thereon. Single color images can also be formed by the same apparatus.

Extremely high-quality electrophotographic color work with dry toner particles requires extremely fine toner particles. Because of difficulties encountered in electrostatically transferring such small toner particles, transfer station 3 is preferably of the thermally assisted type, in which transfer is accomplished by heating both the toner and the thermoplastic layer of the receiving sheet causing preferential adherence between the toner and receiving sheet as compared to the toner and whatever surface is carrying it, in this instance photoconductive drum 20. For this purpose, transfer roller 27 is heated by a lamp 7 which heats the thermoplastic layer 9 to its glass transistion temperature which assists in the transfer of the toner to layer 9 by facilitating the partial embedding of the toner in layer 9.

A multicolor image can also be formed using an intermediate drum or web to which two or more color toners are transferred in registry and then transferred as a single multicolor image to a receiving sheet. Sheet 1 can also receive a multicolor image directly from drum 20 in a single transfer. That image is formed on a photoconductive drum 20 by a known process which exposes and develops second, third and fourth color images on top of previously formed color images.

In summary, any of a number of known techniques may be used to provide a multicolor image of dry, extremely fine toner particles on or slightly embedded in the upper thermoplastic surface of the receiving sheet 1.

Figure 2:
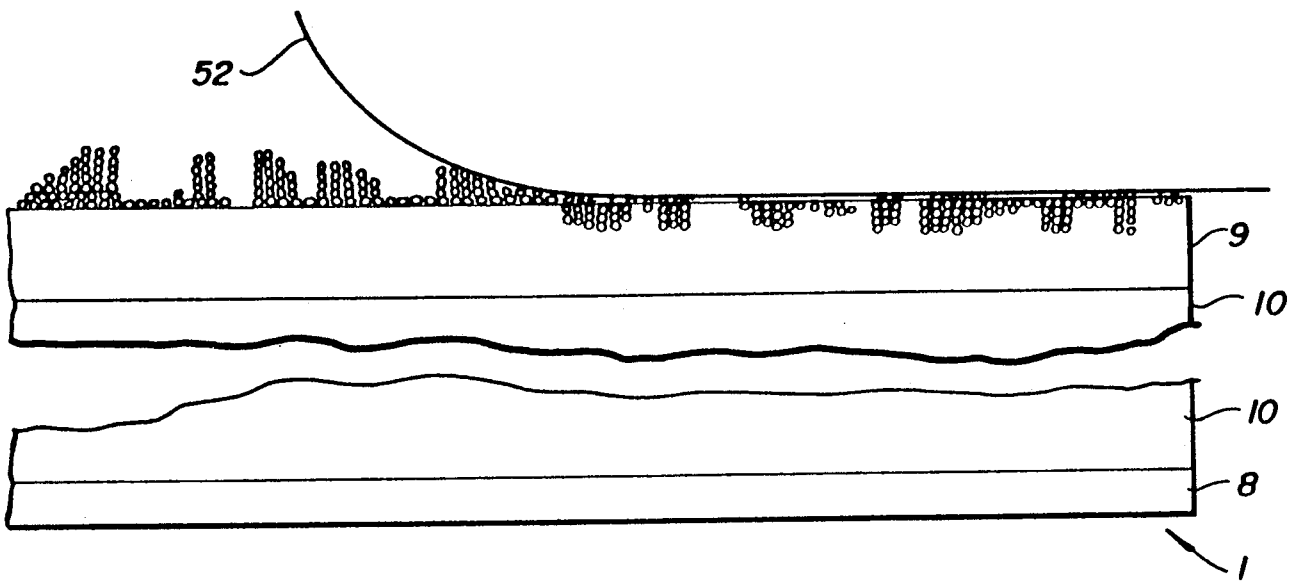
FIG. 2 is a side section greatly magnified illustrating a receiving sheet while toner is being embedded with the apparatus of FIG. 1.

Referring to FIG. 2, these finely-divided toner particles (exaggerated in size in FIG. 2) have a tendency to extend in layers a substantial and varying height above the surface of receiving sheet 1. Ordinary pressure roller fusing has a tendency to only partially flatten the layers of toners. However, it also spreads such layers, increasing substantially the granularity of the image and noticeably impairing its quality.

Further, the fine toner has a tendency to offset on the pressure fuser unless fusing oils are used. Such fusing oils, while acceptable for ordinary copying work, leave blotches on the sheet surface that are unacceptable for very high quality imaging.

Figure 4:
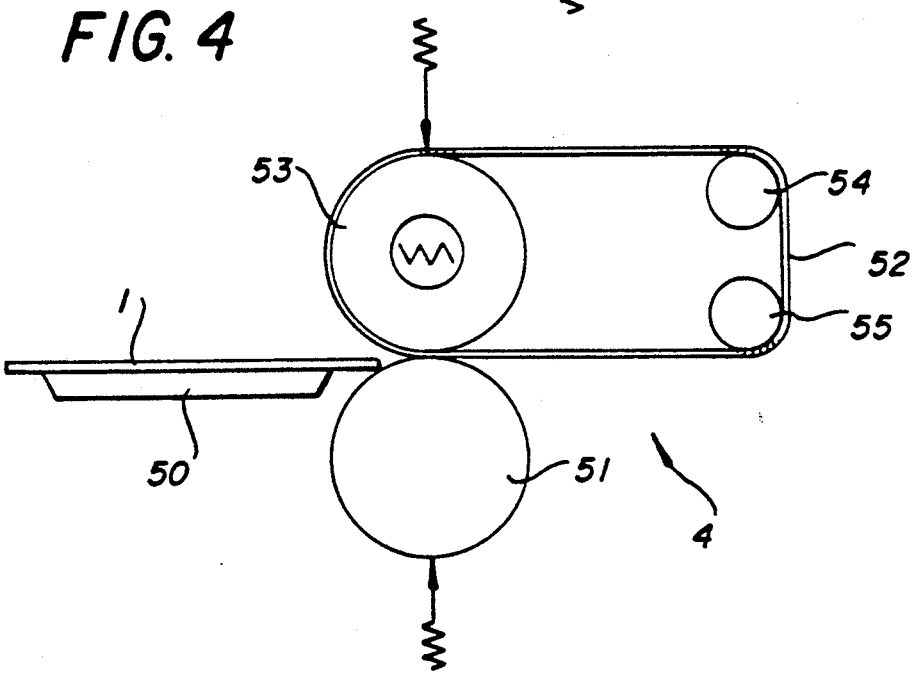
FIG. 4 is a side schematic of one of the components shown in FIG. 1 for embedding the image and applying a gloss to such a receiving sheet.

FIG. 4 illustrates a fixing device 4 shown in FIG. 1 and partially shown in FIG. 2. Fixing device 4 reduces the relief and fixes the toner image in the thermoplastic layer of the receiving sheet. It also can increase the gloss of the surface of the sheet. According to FIG. 4, receiving sheet 1 is fed across a preheating device 50 and into the nip between a pressure roller 51 and a ferrotyping belt 52. Ferrotyping belt 52 is entrained around a large heated roller 53 and unheated rollers 54 and 55. One of the rollers 53, 54 or 55 is rotated by means not shown to drive the belt. Preheating device 50 elevates the temperature of the thermoplastic layer 9 (FIG. 2) to slightly above its glass transistion temperature permitting the ferrotyping web 52 to embed the toner in layer 9 as shown in FIG. 2. Although this process can work with some materials at pressures as low as 40 pounds per square inch and lower, preferably, it is carried out at much higher pressures. For example, pressures of 100 pounds per square inch or greater have been found to be useful.

Figure 3:
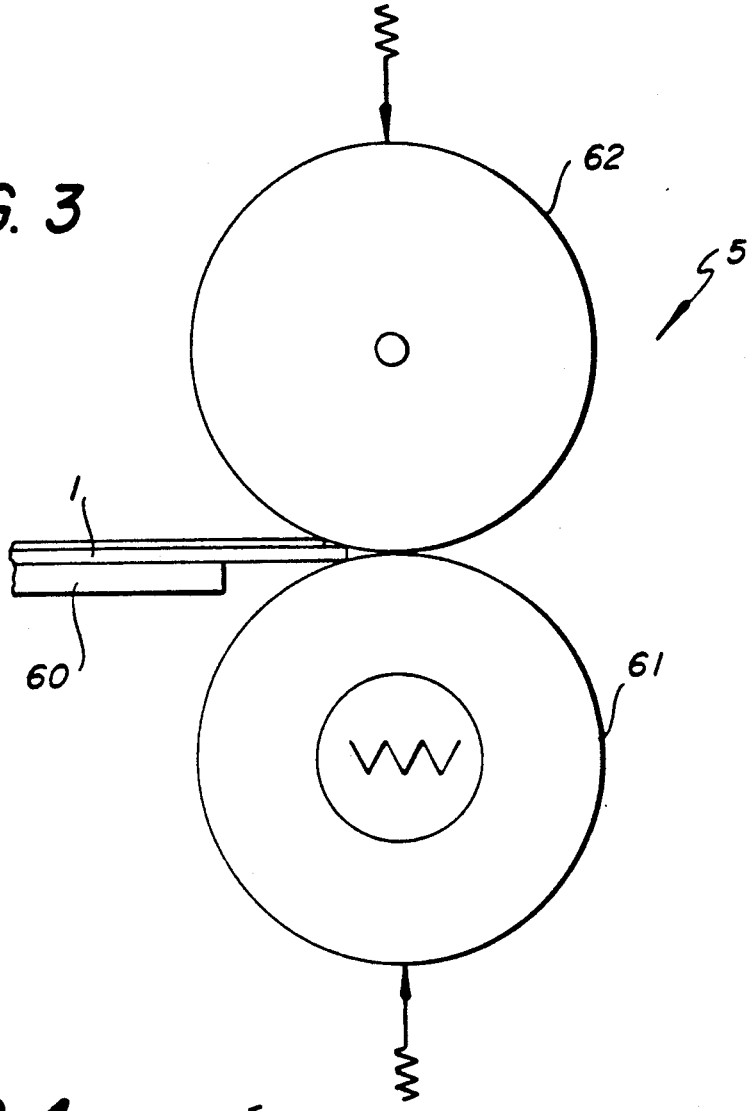
FIG. 3 is a side schematic of one of the components of the apparatus shown in FIG. 1 for applying a texture or gloss to a receiving sheet of the type shown in FIG. 2.

According to FIG. 3, further gloss or a texture can be applied to the surface of the print by a second treatment similar to the first. As shown in FIG. 3, receiving sheet 1 is fed into a nip between a pair of pressure rollers 61 and 62 after again being heated by preheating device 60. Preferably, lower pressure member 61 is heated sufficiently to, in cooperation with preheating device 60, maintain the thermoplastic layer 9 above its glass transition temperature while the pressure members impart a gloss or texture to the surface of sheet 1. Again, relatively high pressures, preferably, 100 pounds per square inch or greater assist in the process. To apply such high pressures, both pressure members are made of metal, for example, aluminum.

In working with both of the devices shown in FIGS. 3 and 4, an image defect was noted at the leading edge of the print. That is, there was a substantial mark in the first one-sixteenth to one-eighth inch of the final image. Upon analysis, it was determined that the leading edge of thermoplastic was offsetting onto the pressure member. In addition to the image defect, the portion of layer 9 that offsets on the pressure member must be cleaned off or it will cause more offset of both layer 9 and toner from the image.

Figure 5:
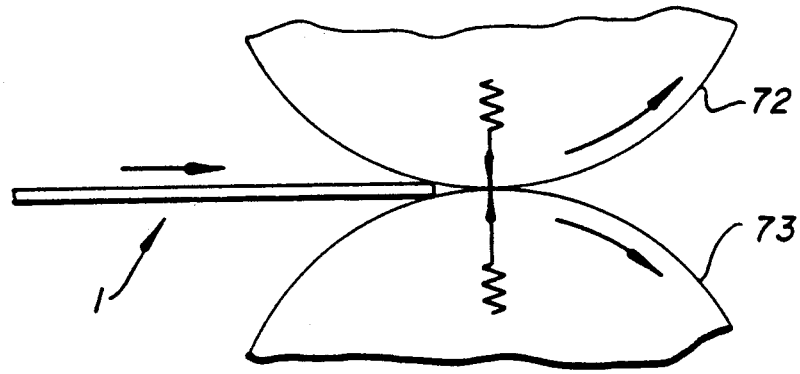
FIG. 5 is a schematic side view of a pair of pressure members and a receiving sheet illustrating the condition which created the image defect described.

This offset at the leading edge could be due to any of several phenomenas. The problem associated with feeding a receiving sheet having a heat softenable layer on at least one side directly into the nip between a pair of rotating pressure rollers is illustrated in FIG. 5. According to FIG. 5, as receiving sheet 1 enters the nip, the edges of the receiving sheet contact the pressure members in advance of the apex of the nip and are pulled into the nip by the rotating pressure members, rollers 72 and 73. The leading edge of the top of receiving sheet 1 is in contact with pressure member 72 longer than the rest of the layer. Further, the introduction of the sheet between the rollers adds inertia that must be overcome by the drives associated with pressure members 72 and 73. Assuming that those drives are not made extremely powerful for their normal job, there will be a hesitation as the drives overcome that inertia. This hesitation causes the leading portion of the top of receiving sheet 1 to spend more time in the nip than does the rest of the layer.

In a system which is attempting to heat the heat softenable layer 9 (FIG. 2) only slightly above its glass transition temperature, for example, 10 degrees C. above its glass transition temperature, this difference in the time spent in the nip is problematic. That is, the leading edge of layer 9 will overheat and will hot offset onto pressure member 72.

Figure 6:
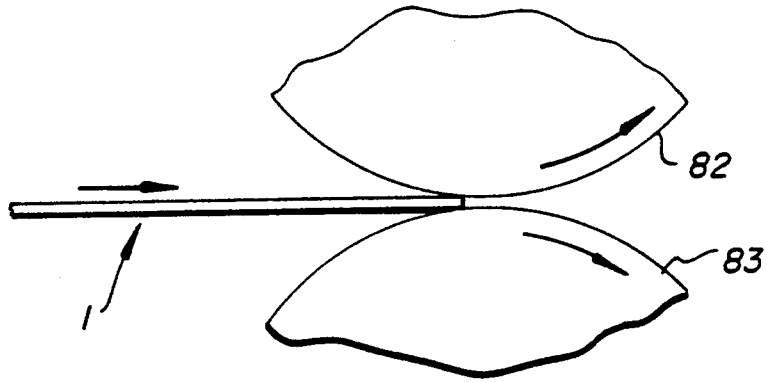
FIGS. 6 and 7 are schematic side views similar to FIG. 5, illustrating the solution of that problem according to the invention.

According to FIG. 6, this problem is solved by delaying the application of pressure between pressure members 82 and 83 until sheet 1 is well within the nip. According to FIG. 6, the sheet 1 approaches the nip with the nip between pressure members 82 and 83 slightly spread. At this point, the sheet has little effect on the rotation of pressure members 82 and 83. According to FIG. 7, a force urging the pressure members 82 and 83 together is applied just as or slightly after the leading edge of the sheet reaches the apex of the nip. Although improvements over the FIG. 5 structure were obtained if the pressure was applied just as the leading edge reached the apex of the nip, we found the best results were obtained when the leading edge was at least one-sixteenth of an inch past the center of the nip.

Figure 7:
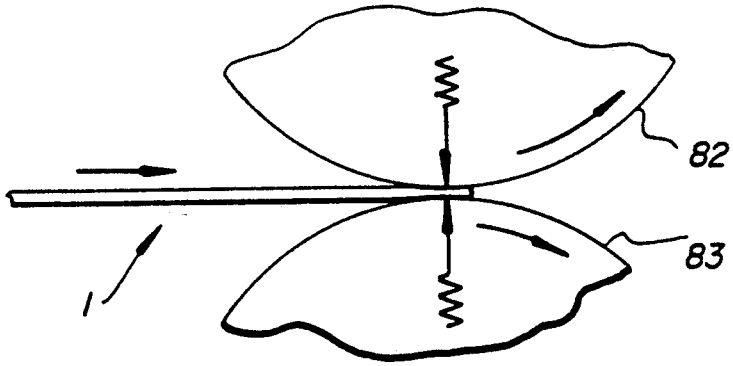
Figure 8:
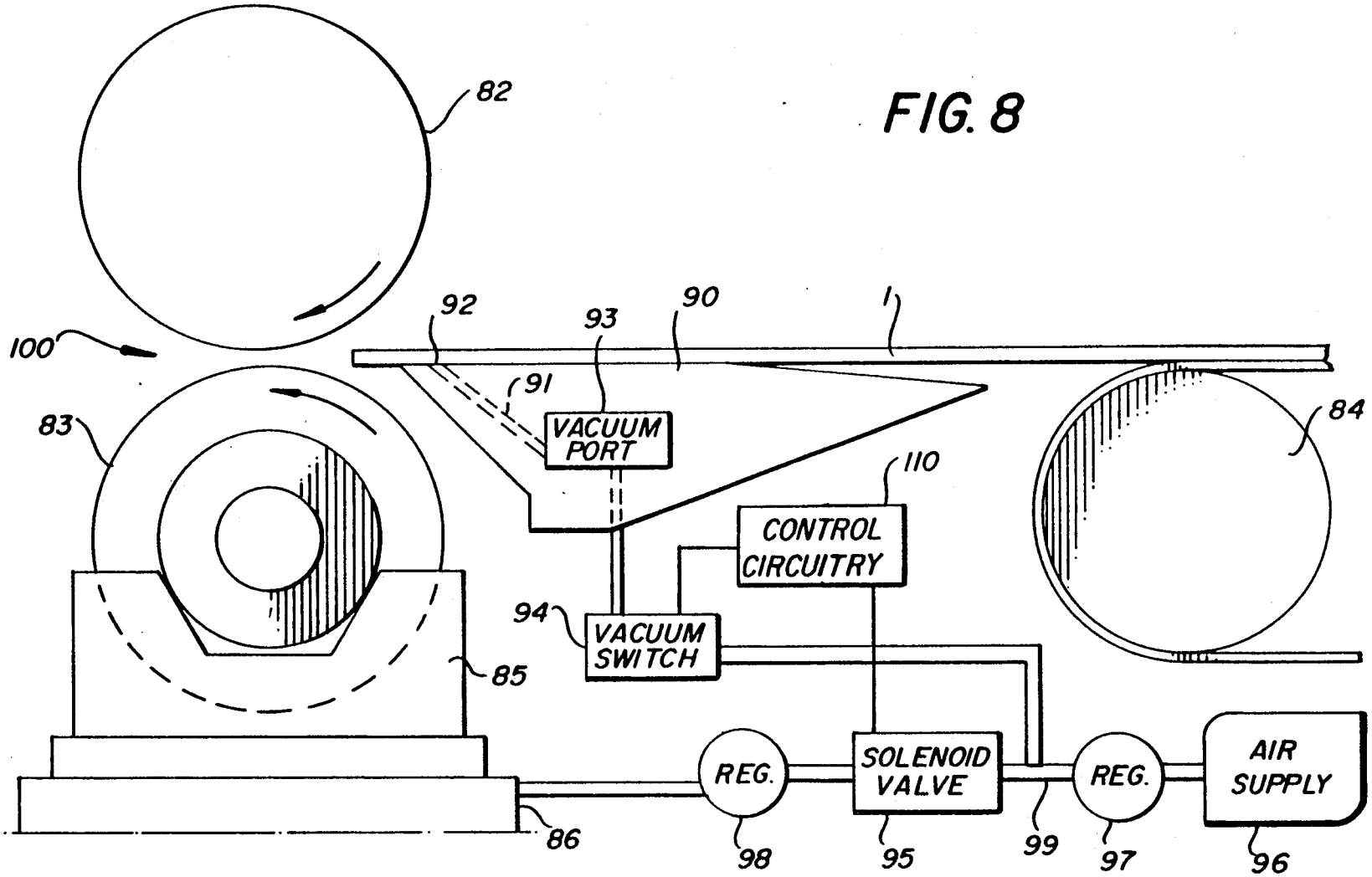
FIG. 8 is a schematic side view of an apparatus for carrying out the invention.

FIG. 8 shows an apparatus for carrying out the solution illustrated in FIGS. 6 and 7. According to FIG. 8 pressure members 82 and 83 are pressure rollers. Pressure member 82 could support a ferrotyping belt as described with respect to FIG. 4. Roller 83 is supported by a yoke 85 which can be driven in an upward direction by an air bladder 86 in response to an application of air thereto from an air supply 96. Air bladder 86 and yoke 85 constitute an urging means which have at least two conditions. A first condition in which sufficient air has been supplied to air bladder 86 for applying the appropriate pressure between pressure members 82 and 83 to accomplish the finishing job intended on sheet 1 and a second condition in which that force is relaxed.

As receiving sheet 1 is fed by a sheet transport 84 toward a nip 100 between pressure members 82 and 83, it passes over a sheet guide 90. Sheet guide 90 has a vacuum hole 91 which runs from an opening 92 in the top surface of guide 90 to a vacuum port 93. Vacuum port 93 is connected by a vacuum line to a vacuum switch 94 which in turn is connected to an air line 99 between an air supply 96 and air bladder 86. Vacuum switch 94 through vacuum port 93 and vacuum hole 91, senses whether opening 92 is open or closed. Vacuum switch 94 sends an electrical signal according to the condition of opening 92 to control circuitry 110.

Air bladder 86 is controlled by a solenoid valve 95 which, in response to a signal from control circuitry 110, opens or closes to inflate or deflate air bladder 86 thereby changing it from its first condition to its second condition and from its second condition to its first condition. Suitable regulators 97 and 98 control the pressure in line 99. For example, pressure between source 96 and solenoid valve 95 may be relatively high, for example, 50 pounds per square inch while the pressure between solenoid valve 95 and air bladder 86 may be relatively low, for example, 10 pounds per square inch.

In operation, receiving sheet 1 is fed toward nip 100 by sheet transport device 84 and first engages and slides upon the top of sheet guide 90 until the leading edge of sheet 1 passes opening 92. Closing of opening 92 causes vacuum switch 94 to send a signal to control circuitry 110. Control circuitry 110 delays the signal from vacuum switch 94 by an amount of time sufficient to position the leading edge of sheet 1 at the center of nip 100. It then sends a signal to solenoid valve 95 which actuates air bladder 86 to apply the urging force between pressure members 82 and 83 as shown in FIG. 7.

The air bladder 86 can be deactivated in response to a sensor, not shown, on the trailing side of nip 100 which senses the trailing edge of sheet 1. However, it is convenient to also use opening 92 for this purpose. Thus, as the trailing edge of sheet 1 passes opening 92, this condition is sensed by vacuum switch 94 which sends a second signal to circuitry 110. Circuitry 110 delays that signal by a suitable amount of time to allow the trailing edge of sheet 1 to leave nip 100. Solenoid valve 95 then releases the air pressure on air bladder 86 and the force urging pressure members 82 and 83 together is relaxed. Obviously, the application of the second signal to solenoid valve 95 need not be timed as critically as that of the first signal.

The invention has been described in detail with particular reference to a preferred embodiment thereof, but it will be understood that variations and modifications can be effected within the spirit and scope of the invention as described hereinabove and as defined in the appended claims.

We claim:

1. Apparatus for finishing a toner image-bearing receiving sheet, which receiving sheet includes a heat softenable outer layer carrying said toner image, said apparatus comprising:

first and second pressure members, at least one of said pressure members being heated, means for feeding said receiving sheet into a nip between said pressure members, means for urging said pressure members together with sufficient force to embed said toner image in said heat softenable layer or to apply a gloss or texturized finish to said layer, said means being adjustable between a first condition in which said force is applied and a second condition in which said force is relaxed, and means for sensing a receiving sheet approaching said nip and for adjusting said urging means to its first condition after the leading edge of said sheet reaches at least the center of said nip.

2. Apparatus according to claim 1 wherein said sensing means includes means for sensing the leading edge of said sheet, and for generating an electrical signal in response thereto, means for applying said electrical signal to said urging means to adjust said urging means to its first condition, and means for delaying said application of said signal to said urging means by a predetermined time allowing said leading edge to move from a position at which it is sensed to a position within said nip.

3. Apparatus according to claim 2 wherein the same means that senses passing of the leading edge also senses passing of the trailing edge and generates a second signal in response thereto which second signal is applied to said urging means to adjust said urging means back to its second condition and means for delaying application of said second signal to said urging means by a predetermined time allowing said trailing edge to move out of said nip.

4. A method of finishing a toner image bearing receiving sheet, which receiving sheet includes a heat softenable outer layer carrying said toner image, said method comprising:

feeding said receiving sheet into a nip between first and second pressure members, heating said heat softenable layer to at least its glass transition temperature, and after the leading edge of said receiving sheet has reached at least the center of said nip, urging said pressure members from a relaxed condition to a pressure applying condition in which said pressure members apply sufficient pressure to embed said toner image in said heat softenable layer or to apply a gloss or texturized finish to said layer.

* * * * *